US005699710A

United States Patent [19]

Creaden

[11] Patent Number: 5,699,710

[45] Date of Patent: Dec. 23, 1997

[54] SLOTTER WHEEL MECHANISM HAVING SELECTIVELY ROTATABLE SLOTTER BLADE

[75] Inventor: David E. Creaden, Lawrence, Kans.

[73] Assignee: Lawrence Paper Company, Lawrence, Kans.

[21] Appl. No.: 837,659

[22] Filed: Apr. 22, 1997

Related U.S. Application Data

[63] Continuation of Ser. No. 513,385, Aug. 10, 1995, abandoned.

[51] Int. Cl.[6] ..... B26D 1/12; B31B 1/14

[52] U.S. Cl. ..... 83/332; 83/345; 83/508.1; 83/678; 493/370; 493/471; 493/475

[58] Field of Search ..... 83/332, 345, 508.1, 83/678, 296, 304, 305, 563, 564, 698.51; 493/365, 367, 368, 370, 471, 475

[56] References Cited

U.S. PATENT DOCUMENTS

| | | | |
|---|---|---|---|
| 1,129,481 | 2/1915 | Gores | 493/354 |
| 1,373,668 | 4/1921 | Pearsall | 493/355 |
| 1,525,238 | 2/1925 | Hurd | 493/355 |
| 1,567,656 | 12/1925 | Langston | 493/355 |
| 1,764,358 | 6/1930 | Smith | 493/60 |
| 1,802,554 | 4/1931 | Hahn | 83/337 |
| 1,832,481 | 11/1931 | Gebhart | 493/60 |
| 1,850,801 | 3/1932 | Langston et al. | 101/248 |
| 1,850,802 | 3/1932 | Langston et al. | 101/248 |
| 1,959,424 | 5/1934 | Hawkins | 493/353 |
| 1,977,812 | 10/1934 | Swift, Jr. | 493/321 |
| 2,117,220 | 5/1938 | Sieg | 493/354 |
| 2,120,920 | 6/1938 | Masters et al. | 493/364 |
| 2,121,105 | 6/1938 | Shields | 74/395 |
| 2,181,197 | 11/1939 | Moritz | 83/673 |
| 2,191,988 | 2/1940 | Greenwood | 493/321 |
| 2,259,441 | 10/1941 | Fitchett | 101/247 |
| 2,422,783 | 6/1947 | Jacobson | 271/136 |
| 2,491,871 | 12/1949 | Morgan | 83/305 |
| 2,662,452 | 12/1953 | Sidebotham | 493/54 |
| 2,674,942 | 4/1954 | Rockstrom | 101/247 |
| 2,701,613 | 2/1955 | Bishop | 83/332 |
| 2,706,944 | 4/1955 | Claff et al. | 101/227 |
| 2,982,189 | 5/1961 | Shields | 493/30 |
| 3,003,403 | 10/1961 | Goettsch | 493/365 |
| 3,008,366 | 11/1961 | Taylor, Jr. | 83/346 |
| 3,031,937 | 5/1962 | Greenwood et al. | 493/354 |
| 3,093,037 | 6/1963 | Ward, Jr. | 493/365 |
| 3,257,882 | 6/1966 | Lulie et al. | 83/864 |
| 3,386,323 | 6/1968 | Dovey | 83/440.1 |
| 3,443,490 | 5/1969 | Bishop | 493/365 |
| 3,466,982 | 9/1969 | Sullivan | 83/492 |
| 3,540,357 | 11/1970 | Ward, Jr. | 493/365 |
| 3,587,374 | 6/1971 | Stewart et al. | 83/56 |
| 3,611,884 | 10/1971 | Hottendorf | 493/55 |
| 3,651,723 | 3/1972 | Gallagher, Jr. et al. | 83/864 |
| 3,855,890 | 12/1974 | Lynch et al. | 83/331 |
| 3,882,765 | 5/1975 | Tokuno | 493/362 |
| 3,952,637 | 4/1976 | Lambert et al. | 493/30 |
| 3,985,066 | 10/1976 | Kern | 493/60 |
| 4,003,300 | 1/1977 | Grobman | 493/365 |
| 4,061,063 | 12/1977 | Brush | 83/55 |

(List continued on next page.)

*Primary Examiner*—Eugenia Jones
*Attorney, Agent, or Firm*—Hovey, Williams, Timmons & Collins

[57] ABSTRACT

An improved slotter wheel apparatus (10) designed for use in the formation of box blanks is disclosed. The apparatus (10) includes a rotatable drive shaft (22), a slotter blade (16) supported on the drive shaft (22) and blade coupling structure (20). The slotter blade coupling structure (20) is operable for selectively coupling the slotter blade (16) with the rotating drive shaft (22) so that the slotter blade (16) is rotated by the shaft (22) and slots blanks passing under the apparatus (10). The slotter blade coupling structure (20) is also operable for selectively decoupling the slotter blade (16) from the drive shaft (22) to prevent the slotter blade (16) from slotting blanks passing under the apparatus (10). In a preferred construction of the invention, the slotter blade coupling structure (20) includes a clutch assembly (76), a brake assembly (78), and a controller (82) for controlling the operation of the clutch and brake assemblies.

29 Claims, 5 Drawing Sheets

U.S. PATENT DOCUMENTS

| | | | |
|---|---|---|---|
| 4,090,433 | 5/1978 | Jardine et al. | 493/352 |
| 4,515,052 | 5/1985 | Flaum | 83/479 |
| 4,712,461 | 12/1987 | Rasmussen | 83/334 |
| 4,725,261 | 2/1988 | Millard et al. | 493/82 |
| 4,742,741 | 5/1988 | Hallberg et al. | 83/37 |
| 4,767,393 | 8/1988 | Smith | 493/342 |
| 4,781,668 | 11/1988 | Mowry | 493/365 |
| 4,805,502 | 2/1989 | Ishigure | 83/332 |
| 5,181,899 | 1/1993 | Hill et al. | 83/332 X |
| 5,297,462 | 3/1994 | Creaden | 83/678 X |
| 5,344,377 | 9/1994 | Meeks | 83/332 X |

SLOTTER WHEEL MECHANISM HAVING SELECTIVELY ROTATABLE SLOTTER BLADE

This application is a continuation of application Ser. No. 08/513,385 filed Aug. 10,1995, now abandoned.

BACKGROUND OF THE INVENTION

1. Field of the Invention

The present invention is broadly concerned with an improved slotter wheel apparatus of the type used in box making operations for the purpose of creating strategically located and sized slots in box blanks which define the flap sections of an ultimate box. More particularly, the invention is concerned with such a slotter wheel apparatus having selectively rotatable slotter blades that can be repositioned during rotation of the slotter wheel apparatus, thus permitting use of a single slotter wheel in the production of a wide variety of box blank sizes.

2. Description of the Prior Art

Conventional box making operations involve initially die cutting a box blank typically formed of corrugated paperboard, followed by creasing and slotting the blank to define the sides and end flaps of the blank. The creasing and slotting operations are typically performed using adjacent, serially aligned creasing and slotting wheels respectively mounted upon powered shafts. As the blank is fed through the creasing/slotting device, the rotating creasing and slotting wheels act on the blank to create a series of spaced slot pairs of desired length separated by continuous creases. In this manner, the side panels and end closure flaps of the final box are formed.

To efficiently produce blanks of varying dimensions, the slotting and creasing wheels may be shifted laterally along the lengths of their supporting shafts. Additionally, cutting blades of varying lengths may be bolted to the slotting wheels at any one of a number of positions thereon, so that the size and location of the flap-defining slots may be altered.

While creasing/slotting devices of the type described above are well known, they suffer from a serious drawback in that there are limitations as to the size of blanks which they may slot. Particularly, since their slotter blades are fixed to their drive wheels, a slot is made in a box blank each time the portion of the drive wheel holding the slotter blade rotates past the box blank. Therefore, the maximum box blank length which may be handled using a conventional slotter wheel is determined by the effective diameter of the wheel and knife blade. If it is desired to produce a larger blank, a larger, more expensive drive wheel must be used.

Slotter wheel devices with adjustable slotter blades are known in the art. For example, U.S. Pat. No. 4,805,502 describes a slotter wheel device including a wheel-supporting shaft having an eccentric axis permitting selective movement of the supported slotting blades to a non-cutting position. However, to shift the slotting blades to the non-cutting position, it is necessary to stop the operation of the wheel, manipulate the eccentric axis to alter the blade position, and then resume slotting operations. Thus, the '502 device is incapable of positioning a slotting blade between a cutting position and an idle, blank-clearing position during rotation of the slotting wheel and cannot accommodate oversized box blanks.

U.S. Pat. Nos. 5,297,462 and 5,327,804 disclose slotter wheel mechanisms having dynamically retractable slotter blades that allow the formation of boxes of various sizes. These patents provide greatly improved box making operations which allow the "skipping" of cutting during one or more successive slotter wheel revolutions. With this configuration, blanks of virtually any size may be readily slotted without stopping the slotter wheel device and without the need for employing larger diameter slotter wheels.

Although the '462 and '804 patents provide a distinct advance in the art of slotter wheel mechanisms, their blade-shifting mechanisms are difficult to construct and somewhat costly. Accordingly, there is a need for an improved slotter wheel apparatus that permits selective positioning of the slotter blades during rotation of the slotter wheel so that blanks of virtually any length can be formed with standard sized slotter machines. More particularly, there is a need for an improved slotter wheel apparatus that performs the above-described features yet is relatively simple and inexpensive to construct.

SUMMARY OF THE INVENTION

The present invention overcomes the problems outlined above, and provides a greatly improved slotter apparatus for box making operations. More particularly, the slotter wheel apparatus of the present invention includes structure for selectively rotating the slotter blades during rotation of the slotter wheel between a cutting position wherein the slotter blades rotate with the slotter wheel and an idle or non-cutting position wherein the slotter blades are stationary and thus do not come into contact with boxes being driven by the slotter wheel. This allows selective control of the slotting operation during rotation of the slotter wheel so that blanks of virtually any practical length can be formed on standard sized slotting machines without the need to stop the slotter wheel and readjust the slotter blades. Additionally, the invention provides structure for rotating the slotter blades that is relatively simple and inexpensive to construct.

The preferred slotter wheel apparatus broadly includes a drive assembly including a rotatable drive shaft, a rotatable blade wheel including a slotter blade secured thereto, support structure for supporting the blade wheel on the drive assembly for rotation about the drive shaft, and blade coupling structure for selectively coupling and decoupling the slotter blade with the drive assembly for rotating the slotter blade between a cutting position and a non-cutting position. In more detail, the blade coupling structure is operable for selectively coupling the blade wheel and slotter blade with the drive shaft so that the slotter blade is rotated by the drive shaft for slotting box blanks, and for selectively decoupling the blade wheel and the slotter blade from the drive shaft for preventing the slotter blade from slotting box blanks.

In a first embodiment of the invention, the blade coupling structure broadly includes a clutch assembly, a brake assembly, and a controller for controlling the operation of the clutch and brake assemblies. The clutch assembly is provided for rotatably coupling the blade wheel with the drive wheel and is selectively shiftable between an engaged position and a released position. In the engaged position, the clutch assembly couples the blade wheel with the drive wheel so that the blade wheel and slotter blade rotate with the drive wheel. In the released position, the clutch assembly decouples the blade wheel from the drive wheel so that the blade wheel and slotter blade rotate independently of the drive wheel.

The brake assembly is provided for braking the blade wheel and is selectively shiftable between a braked position and an unbraked position. In the braked position, the brake assembly stops rotation of the blade wheel. In the unbraked position, the brake assembly allows the blade wheel to rotate freely.

The controller controls the operation of both the clutch assembly and the brake assembly for positioning the slotter blade either in a cutting position or a noncutting or idle position. To position the slotter blade in the cutting position, the controller shifts the clutch assembly to the engaged position and shifts the brake apparatus to the unbraked position. This rotatably couples the blade wheel with the drive wheel so that the slotter blade makes a cut during every rotation of the drive wheel. Conversely, to position the slotter blade in the idle position, the controller shifts the clutch assembly to the released position and shifts the brake apparatus to the braked position. This decouples the blade wheel from the drive wheel and brakes the blade wheel in a non-cutting position so that the slotter blade does not make a cut during rotation of the drive wheel.

In a second embodiment of the invention, the apparatus includes a gear assembly that rotates the blade wheel and slotter blade independently of the drive wheel. The gear assembly includes a servo motor, a pulley assembly coupled with the servo motor, and a toothed blade wheel coupled with the slotter blade. The gear assembly rotates the slotter blade at various speeds independently of the rotational speed of the drive assembly. This allows the rotational speed of the slotter blade to be selected so that the slotter blade can be rotated between cutting and non-cutting positions.

By constructing a slotter wheel apparatus constructed in accordance with the above-described embodiments, numerous advantages are realized. For example, by providing blade coupling structure that selectively rotates the slotter blade between a cutting position and an idle, non-cutting position, box blanks of nearly any length can be slotted without employing a plurality of various sized slotter wheels.

Additionally, by providing a blade coupling structure that selectively couples the slotter blade with the drive shaft and decouples the slotter blade from the drive shaft during continued rotation of the drive shaft, the slotter wheel apparatus can be reconfigured to slot boxes of various sizes without stopping the rotation of the apparatus.

Finally, by providing a blade coupling structure that selectively couples and decouples the slotter blade with the drive shaft during rotation of the drive shaft, the present invention eliminates the need for expensive and complicated drive shafts having eccentric axes and slotter blades having retractable positioning structures.

DETAILED DESCRIPTION OF THE PREFERRED EMBODIMENTS

I. CONSTRUCTION OF FIGS. 1–9

Figure 1:
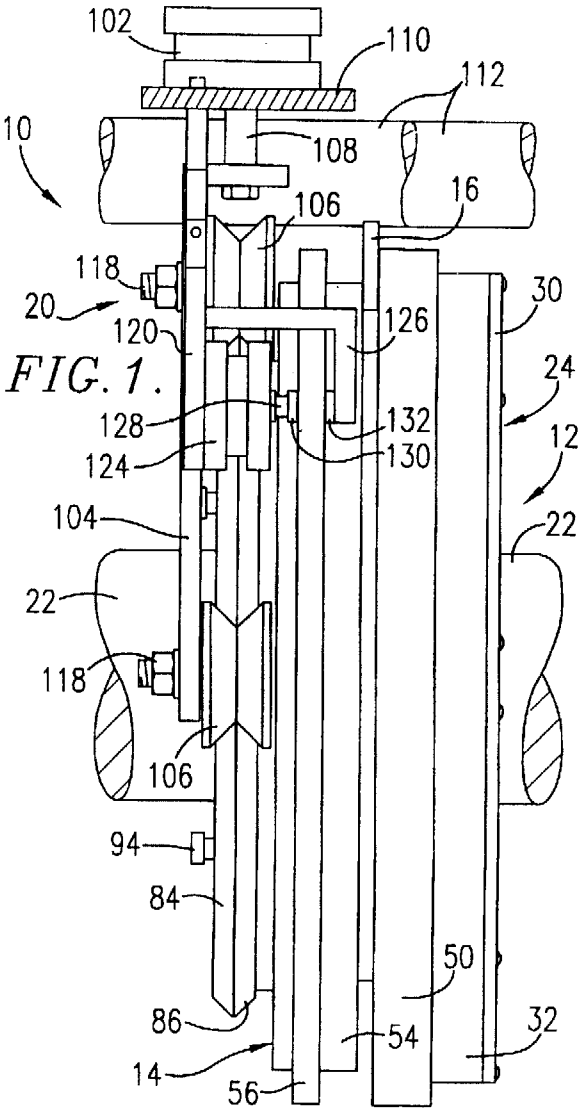
FIG. 1 is a side elevational view of a slotter wheel apparatus constructed in accordance with a first embodiment of the invention.

Turning now to the drawing figures, and particularly FIG. 1, a slotter wheel apparatus 10 constructed in accordance with a first preferred embodiment of the invention is depicted. The slotter wheel apparatus 10 broadly includes a rotatable drive assembly 12, a rotatable blade wheel 14 having a slotter blade 16 secured thereto, blade support structure broadly referred to by the number 18 in FIG. 2 for supporting the blade wheel 14 on the drive assembly 12, and blade coupling structure broadly referred to by the number 20 for selectively coupling and decoupling the blade wheel 14 and slotter blade 16 with the drive assembly 12 during rotation of the drive assembly. As described in more detail below, the blade coupling structure 20 rotates the blade wheel 14 and slotter blade 16 between a cutting position wherein the slotter blade 16 rotates through the path of movement of box blanks, and an idle, non-cutting position wherein the slotter blade 16 is out of contact with the box blanks during continual rotation of the drive assembly 12.

Figure 4:
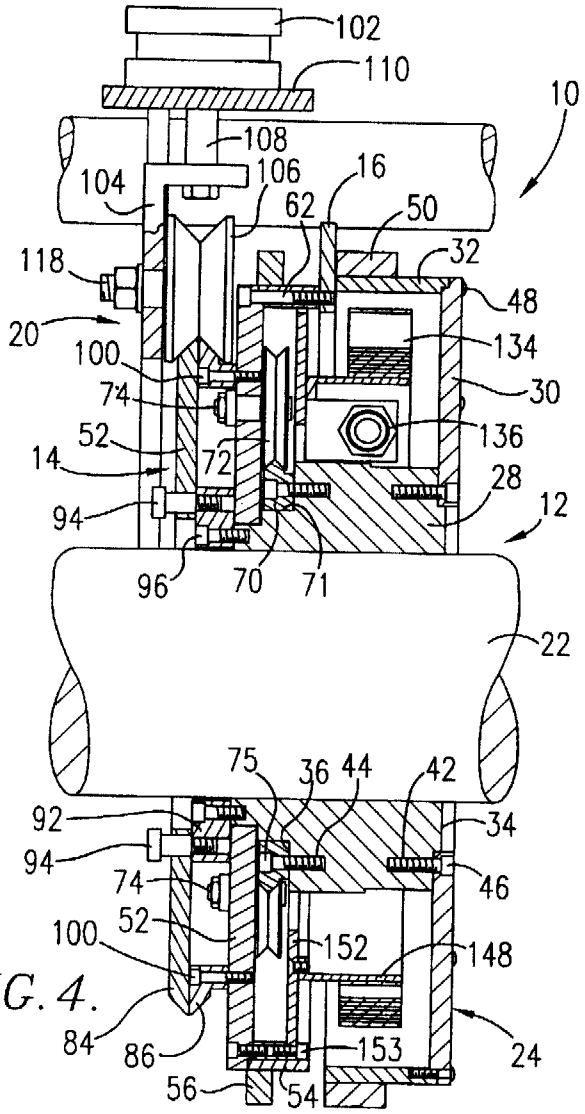
FIG. 4 is a sectional view taken along line 4—4 of FIG. 3.

Referring to FIG. 4, the rotatable drive assembly 12 broadly includes a drive shaft 22, a drive motor for rotating the drive shaft 22, and an annular drive wheel 24 secured to the drive shaft 22. The drive shaft 22 is of conventional construction and includes a keyway 26 extending along the length thereof shown in FIG. 2. The drive motor is also of conventional construction and is provided for rotating the drive shaft at a speed suitable for moving box blanks through the apparatus 10 and forming and slotting the box blanks.

The annular drive wheel 24 is coupled with the drive shaft 22 for rotation therewith and includes a central hub portion 28, a circular disk portion 30, and an outer drive drum 32. The central hub portion 28 is a ring-shaped, metallic body that couples the drive wheel 24 with the drive shaft 22. The hub 28 is coaxial with the drive shaft 22 and presents a front end face 34, a rear end face 36, and a keyway 38 shown in FIG. 3 extending along its length.

The hub 28 is secured to the drive shaft 22 by an elongated, metallic key 40 that couples the keyways 26 and 38 together. The hub 28 also includes a plurality of threaded apertures 42 shown in FIG. 3 spaced about its front end face and a plurality of threaded apertures 44 shown in FIG. 4 spaced about its rear face for receiving corresponding screws as described below.

Returning to FIG. 4, the circular disk portion 30 is a metallic washer-shaped member that is coaxial with the drive shaft 22. The disk portion 30 extends radially from the front end face 34 of the hub 28 and is secured thereto by a plurality of screws 46 extending into the hub apertures 42.

The outer drive drum 32 is a ring-shaped, metallic body that is coaxial with the drive shaft 22 and secured to the outer circumferential edge of the circular disk portion 30 by screws 48. The drive drum 32 includes a metallic drive ring 50 secured thereto for engaging and driving the box blanks under the slotter wheel apparatus 10 for associated cutting and slotting. The drive ring 50 presents a knurled or textured outermost edge for facilitating the engagement of the box blanks.

The rotatable, annular blade wheel 14 is provided for carrying the slotter blade 16 for making cuts and slots in boxes as they pass through the apparatus 10. Referring to FIG. 1, the blade wheel 14 is positioned adjacent the drive wheel 24 along the longitudinal axis of the drive shaft 22 and is rotatable about the shaft 22. As best illustrated in FIG. 4, the blade wheel 14 includes a circular disk portion 52, an outer drum 54, and a brake ring 56.

The circular disk portion 52 is a metallic, washer-shaped member that is coaxial with the drive shaft 22 and presents an inner circumferential edge and an outer circumferential edge. The inner edge is radially spaced a slight distance from the drive shaft 22 and the drive wheel hub 28 so that it rotates about the drive shaft 22 without contacting the drive shaft 22 or hub 28.

The outer drum 54 is a ring-shaped, metallic member that is also coaxial with the drive shaft 22. The outer drum 54 is preferably integrally formed with the outer radial edge of the circular disk portion 52 but may also be secured thereto with screws. The brake ring 56 is an annular, metallic ring-shaped member that is secured to the outer drum 54 for engagement by the brake assembly as described in detail below.

Figure 2:
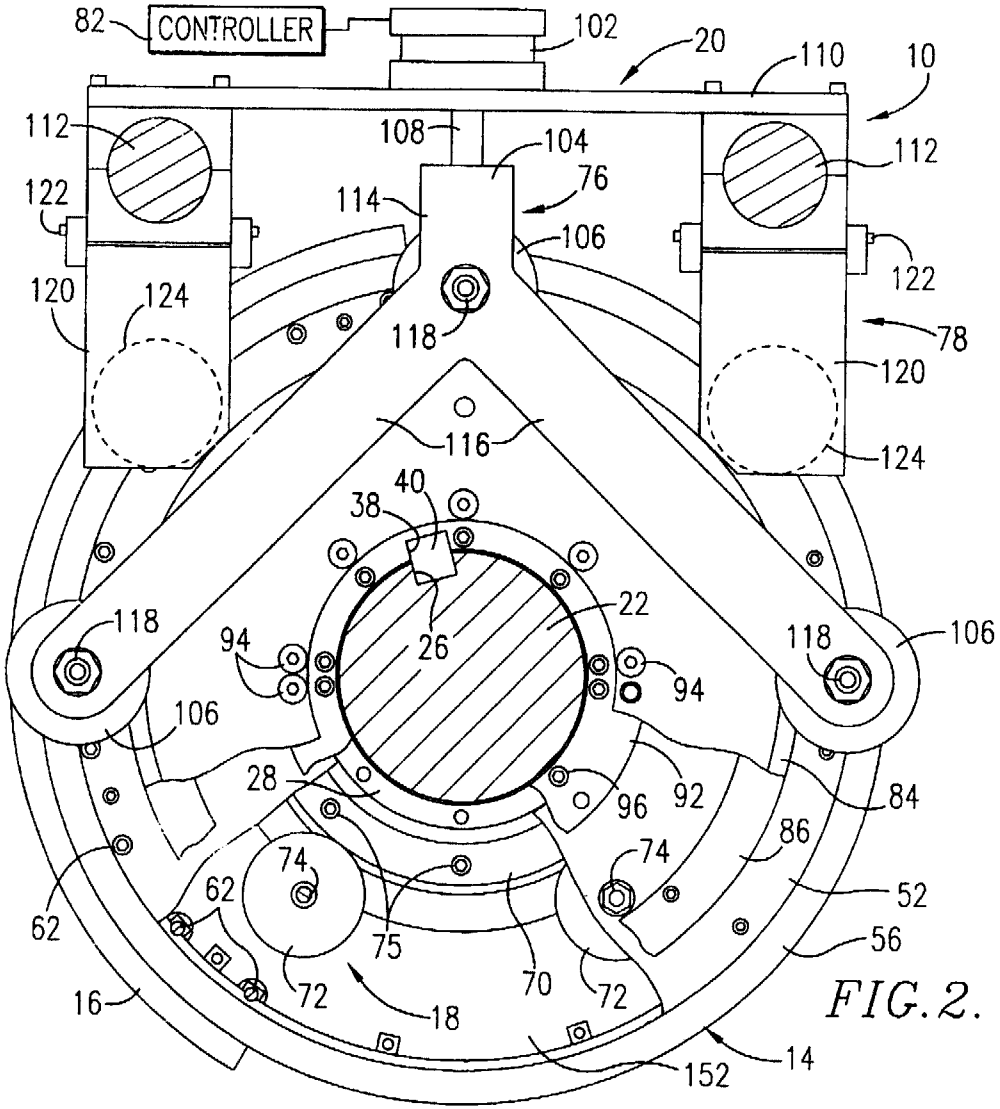
FIG. 2 is a rear end elevational view of the slotter wheel apparatus with parts broken away for more clearly illustrating the invention.

The slotter blade 16 is secured to the blade wheel 14 for making cuts and slots in box blanks during rotation of the blade wheel 14. As best illustrated in FIG. 2, the slotter blade 16 is of conventional construction and includes an arcuate metallic body presenting a cutting edge. The slotter blade 16 can be manufactured in various sizes for forming slots and cuts of any length and width in box blanks. The slotter blade 16 is secured to the outer drum 54 of the blade wheel 14 by screws 62 as shown in FIG. 4.

Returning to FIG. 2, the support structure 18 supports the blade wheel 14 and slotter blade 16 for rotation about the drive shaft 22 and includes an annular track 70 and a plurality of blade wheel rollers 72. The track 70 is supported on a stepped end section 71 formed in the rear end face 36 of the hub 28. The track 70 rotates with the hub 28 and is secured thereto by a plurality of screws 75 extending into corresponding apertures in the hub 28. The track 70 is coaxial with the drive shaft 22 and preferably presents an outer circumferential, inverted V-shaped track surface for engaging the blade wheel rollers 72 as described below.

The blade wheel rollers 72 are rotatably coupled with the planar disk portion 52 of the blade wheel 14 by bolt assemblies 74. The blade wheel rollers 72 are preferably rotatably mounted about eccentric axes for permitting repositioning relative to the track 70. As illustrated in FIG. 4, the blade wheel rollers 72 present an inner circumferential, V-shaped roller surface for engaging the inverted V-shaped track surface of the circular track 70. When coupled with the track 70, the blade wheel rollers 72 rotate thereabout for permitting the blade wheel 14 to rotate about the drive wheel shaft 22.

The blade coupling structure 20 selectively rotates or stops the blade wheel 14 and slotter blade 16 during rotation of the drive assembly 12 for permitting selective slotting of box blanks during operation of the slotter wheel apparatus 10. As best illustrated in FIG. 2, the preferred blade coupling structure 20 broadly includes a clutch assembly 76, a brake assembly 78, a spring assembly 80 (see FIG. 3), and a controller 82 for controlling the operation of the clutch and brake assemblies.

As described in more detail below, the components of the blade coupling structure 20 cooperate for positioning the slotter blade 16 between a cutting position wherein the blade wheel 14 and slotter blade 16 rotate with the drive wheel 24 for slotting box blanks passing thereunder, an idle or non-cutting position wherein the blade wheel 14 and slotter blade 16 are stationary relative to the drive wheel 24 for permitting box blanks to pass without being slotted, and a coast position wherein the blade wheel 14 and slotter blade 16 rotate independently of the drive wheel 24 for repositioning the slotter blade 16 relative to a fixed point on the drive wheel 24.

The clutch assembly 76 is provided for selectively coupling the blade wheel 14 with the drive wheel 24 for causing the wheels to rotate together and broadly includes a clutch plate 84 secured to the drive wheel 24, a clutch ring 86 secured to the blade wheel 14, and a clutch mechanism for selectively coupling the clutch plate 84 with the clutch ring 86 during rotation of the drive wheel 24.

Referring to FIG. 4, the clutch plate 84 is a metallic washer-shaped member that is coaxial with the drive shaft 22. The clutch plate 84 is secured to an annular support ring 92 by a plurality of guide bolts 94, and the ring 92 is secured to the drive wheel hub 28 by a plurality of screws 96. Thus, the clutch plate 84 rotates with the drive wheel 24 about the drive shaft 22. The guide bolts 94 allow the clutch plate 84 to shift away from the clutch ring 86 a short distance along an axis parallel to the longitudinal axis of the drive shaft 22 as described in more detail below. The outer circumferential edge of the clutch plate 84 is bevelled to present a sloped surface for engaging the rollers 72.

The clutch ring 86 is an annular metallic ring-shaped member that is also coaxial with the drive shaft 22. The clutch ring 86 is secured to the blade wheel 14 by a plurality of screws 100 extending through the planer disk portion 52 of the blade wheel. Thus, the clutch ring 86 rotates with the blade wheel 14 about the drive shaft 22. The outer circumferential edge of the clutch ring 86 is also bevelled to present a sloped surface. As illustrated in FIG. 4, when the clutch plate 84 is adjacent the clutch ring 86, the beveled edges form an inverted V track surface for engaging the clutch rollers as described below.

The clutch mechanism is operable for selectively coupling the clutch plate 84 with the clutch ring 86 for forcing the blade wheel 14 to rotate with the drive wheel 24. Referring again to FIGS. 1 and 2, the clutch mechanism includes a clutch cylinder 102, a clutch yoke 104, and a plurality of clutch rollers 106.

The clutch cylinder 102 is a conventional pneumatic cylinder having a retractable piston rod 108 that is shiftable in a direction transverse to the longitudinal axis of the drive shaft 22. The clutch cylinder 102 is preferably supported above the drive wheel 22 and blade wheel 14 by a metallic support plate 110, with the retractable piston rod 108 extending downward through an aperture formed near the midpoint of the support plate 110. The support plate 110 is in turn supported by a pair of elongated support rods 112 extending parallel to the longitudinal axis of the drive shaft 22.

The clutch yoke 104 is a metallic support member secured to the lower end of the retractable piston rod 108 and is spaced slightly from the rear face of the blade wheel 14. The clutch yoke 104 includes a short, vertically extending base section 114 and a pair of depending leg sections 116 that form an inverted-Y configuration. The depending leg sections 116 extend to opposite sides along the circumferential edge of the blade wheel 14.

The clutch rollers 106 are rotatably mounted to the clutch yoke 104 near the base section 114 and at the ends of the depending leg sections 116 by bolt assemblies 118. The clutch rollers 106 each have a roller surface that is V-shaped for securely engaging the beveled edges of the clutch plate 84 and clutch ring 86 as illustrated in FIG. 4.

The components of the clutch mechanism are selectively shiftable between an engaged position and a released position. In the engaged position, the clutch cylinder 102 extends the piston rod 108 and yoke 104 downward until the clutch rollers 106 engage the clutch plate 84 and clutch ring 86. As the clutch rollers 106 engage the clutch plate 84, the clutch plate 84 shifts inward on the guide bolts 94 until it is frictionally secured to the clutch ring 86. Since the clutch plate 84 is secured to the drive wheel 24 and the clutch ring 86 is secured to the blade wheel 14, the shifting of the clutch mechanism to the engaged position causes the blade wheel 14 to become rotatably coupled with the drive wheel 24 due to surface contact between opposing end faces of the plate 84 and the ring 86.

In the released position, the clutch cylinder 102 retracts the piston rod 108 and yoke 104 upwards until the clutch rollers 106 disengage the clutch plate 84 and clutch ring 86. This decouples the blade wheel 14 from the drive wheel 24 so that the blade wheel 14 rotates independently of the drive wheel 24.

The brake assembly 78 is provided for braking the blade wheel 14 and includes a pair of brake units 120 suspended from opposite ends of the support frame 110 as shown in FIG. 2. The brake units 120 are preferably hingedly attached to the support frame 110 by pivot rod assemblies 122 for facilitating the alignment of the units on the blade wheel brake ring 56.

Referring to FIG. 1, each brake unit 120 includes a brake cylinder 124 and a brake arm 126. The brake cylinders 124 are conventional pneumatically operated cylinders and are preferably connected to the same air source as the clutch cylinder 102. Each brake cylinder 124 includes a retractable piston rod 128 that extends and retracts toward the brake ring 56 along an axis parallel to the longitudinal axis of the drive shaft 22. Brake pads 130 are secured to the distal ends of the piston rods 128 for engaging one side of the brake ring 56.

Each brake arm 126 is a metallic L-shaped support member having a depending leg section that extends to the side of the brake ring 56 opposite its respective brake cylinder 124. Brake pads 132 are secured to the ends of the depending leg sections opposite the brake cylinders 124 so that the brake ring 56 is sandwiched by brake pads 130 and 132.

The brake assembly 78 is selectively shiftable between a braked position and an unbraked position. In the braked position, the brake cylinders 124 extend their piston rods 128 toward the brake ring 56 so that the brake pads 130 and 132 engage their respective sides of the brake ring 56 for braking the blade wheel 14. As described in more detail below, this holds the blade wheel 14 in the idle position. In the unbraked position, the brake cylinders 124 retract their brake pistons 128 away from the brake ring 56 so that the brake pads disengage the brake ring 56. This of course allows the blade wheel 14 to rotate freely.

Figure 3:
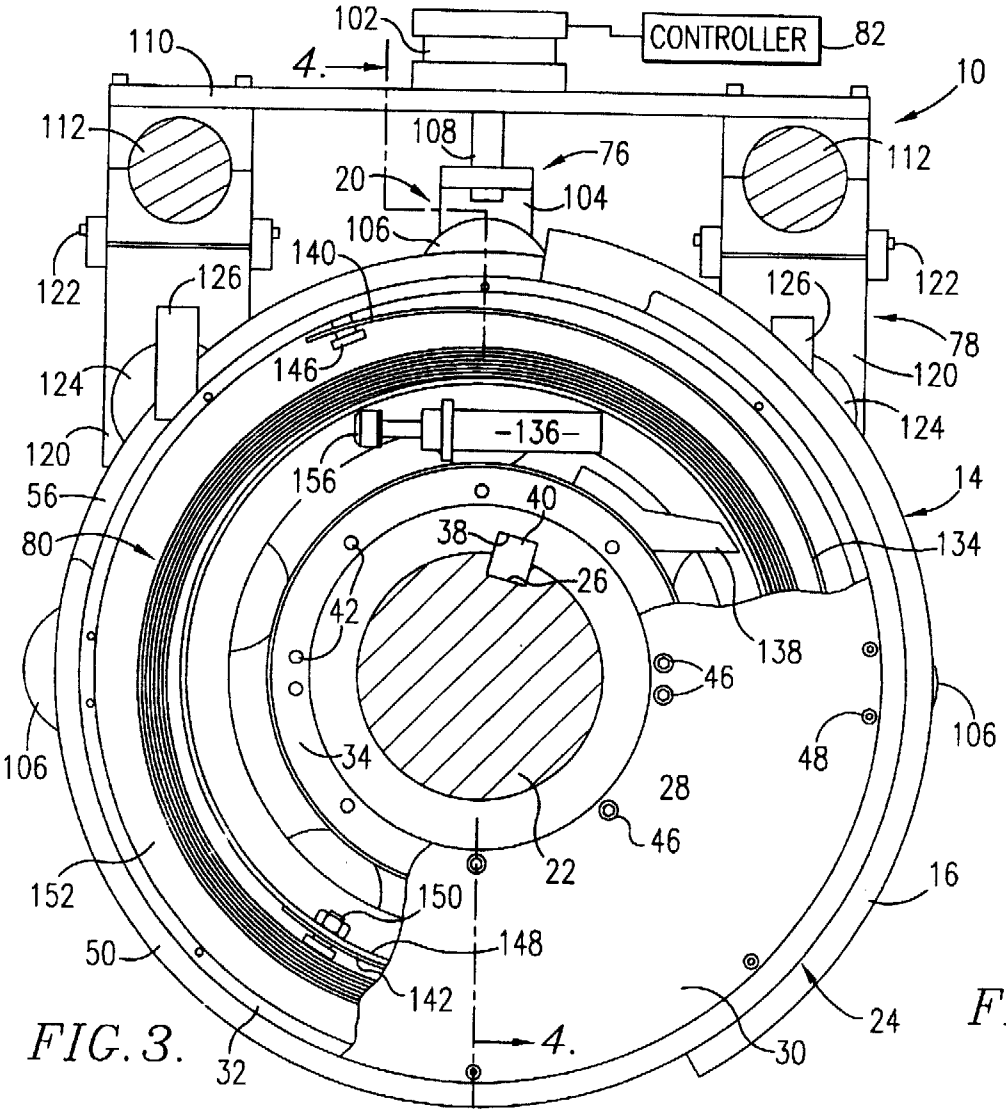
FIG. 3 is a front end elevational view with parts broken away for more clearly illustrating the invention.

The spring assembly 80 provides a force for biasing the blade wheel 14 in a forward rotational direction relative to the drive wheel 24. As best illustrated in FIGS. 3 and 4, the spring assembly 80 includes an elongated spring 134, a snubber 136 and a spring stop 138.

The spring 134 is an elongated constant force spring presenting opposed ends 140 and 142. As illustrated in FIG. 3, the first spring end 140 is secured to the drive wheel 24 by way of a shoulder bolt 146. The second spring end 142 is attached to an annular spring drum 148 by bolt assembly 150, and the spring drum 148 is secured to a spring disk 152. The spring disk 152 is in turn secured to the blade wheel 14 by screws 153 as shown in FIG. 4. The spring 134 is wound or coiled about the spring drum 148 to provide sufficient spring length to allow the drive wheel 24 and blade wheel 14 to rotate independently for a short distance before becoming overcome by the spring force.

The stretching and recoiling of the spring 134 biases the blade wheel 14 toward a "home" or fixed position relative to the drive wheel 24. When the blade wheel 14 is the idle position, the drive wheel 24 is rotating but the blade wheel 24 is stationary. Thus, the first spring end 140 rotates with the drive wheel 24 but the second spring end 142 is stationary, causing the spring to stretch. Then, when the blade wheel 14 is in the coast position, the blade wheel 14 is allowed to rotate independently of the drive wheel 24, and the stretched spring recoils and causes the blade wheel 14 to rotate at a faster speed and overtake the drive wheel 24, returning the blade wheel 14 toward the home position.

The snubber 136 and the spring stop 138 cooperate for limiting the rotational travel of the blade wheel 14 relative to the drive wheel 24 while the blade wheel 14 is in the coast position. This ensures that the blade wheel 14 will not overtake the drive wheel 24 and will eventually rotate to the same home position relative to the drive wheel 24 after every cutting operation.

The snubber 136 is secured to the blade wheel 14 and includes a stop 156 formed of rubber or other suitable resilient material. The spring stop 138 is secured to the drive wheel 24 and is positioned so that it engages the snubber 136 when the snubber 136 completes a full rotation relative to the spring stop 138. Thus, when the blade wheel 14 is in the coast position, the snubber 136 and the spring stop 138 prevent the blade wheel 14 from rotating beyond a fixed home point relative to the drive wheel 24.

The controller 82 controls the operation of the clutch assembly 76 and the brake assembly 78 for positioning the slotter blade 16 between the cutting, idle, and coast positions. The controller 82 is preferably an electromechanical or microprocessor driven control apparatus having a plurality of manually or mechanically operated switches, but may also include a conventional IBM compatible microcomputer or similar microprocessor driven device programmed for performing the control steps described below.

To position the slotter blade 16 in the cutting position, the controller 82 shifts the clutch assembly 76 to the engaged position and shifts the brake assembly 78 to the unbraked position. This couples the blade wheel 14 with the drive wheel 24 and disengages the brake assembly 78 so that the wheels rotate together. Since the slotter blade 16 is fixed to the blade wheel 14, it also rotates with the drive wheel 24 and makes a slot during every rotation of the drive wheel 24.

To position the slotter blade 16 in the idle position, the controller 82 shifts the clutch assembly 76 to the released position and shifts the brake assembly 78 to the braked position. This decouples the blade wheel 14 from the drive wheel 24 and locks the blade wheel 14 in a stationary position. This also causes the spring 124 to wind about the spring drum 148 on the blade wheel 14 because the drive wheel 24 continues to rotate.

Finally, to position the slotter blade 16 in the coast position, the controller 82 shifts the clutch assembly 76 to the released position and shifts the brake assembly 78 to the unbraked position. This decouples the blade wheel 14 from the drive wheel 24 and releases the brake assembly 78 so that the blade wheel 14 rotates freely but independently of the drive wheel 24 until the snubber 136 engages the spring stop 138.

Figure 5:
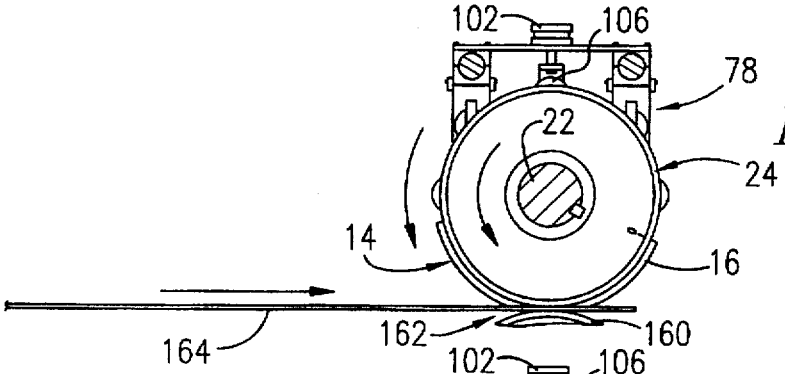
FIG. 5 is a front end elevational view illustrating the blade wheel and slotter blade positioned in a first cutting position.
Figure 6:
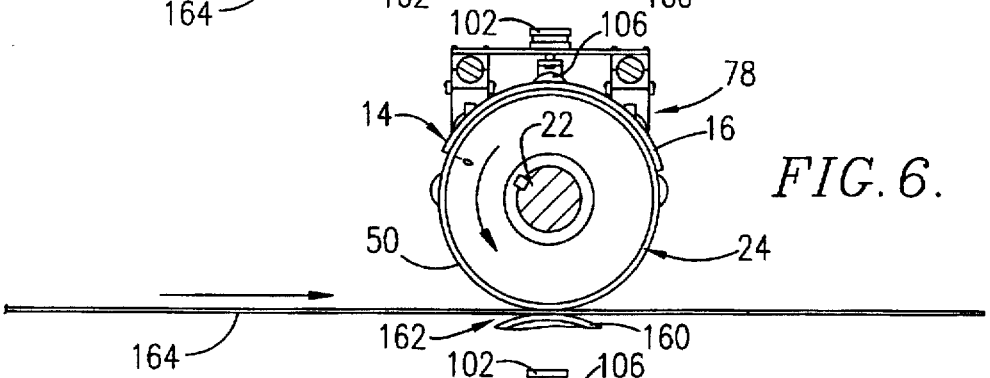
FIG. 6 is a front end elevational view illustrating the blade wheel and slotter blade positioned in a first idle position.

As illustrated in FIG. 5, the slotter wheel apparatus 10 also includes a lowermost anvil wheel 160, which is cooperatively positioned relative to the drive wheel 24 to present a blank-receiving nip region 162 between these wheels. The anvil wheel 160 is typically of bifurcated construction, presenting a pair of spaced apart wheel plates which cooperatively receive the cutting edge of the slotter blade 16 during cutting and slotting operations.

II. Operation of Construction Illustrated in FIGS. 1–9

In operation of the first embodiment of the invention, the slotter wheel apparatus 10 is operable for slotting box blanks at selectively variable locations along the length of the blanks without stopping the rotation of the drive wheel 24. The following paragraphs describe a specific operating sequence for the slotter wheel apparatus 10 for the purposes of describing a preferred embodiment of the invention. Those skilled in the art will appreciate that the slotter wheel apparatus 10 and controller 82 can be configured to provide numerous other operating sequences for slotting box blanks of nearly any length and in any control scheme.

As best illustrated in FIGS. 5–9, once the blade wheel 24 has accelerated to its appropriate speed by the corresponding motor, box blanks 164 are advanced towards the drive wheel 24. The curved arrows in FIGS. 5–9 indicate the rotation of the drive wheel 24 and blade wheel 14, with the innermost arrow indicating rotation of the drive wheel 24 and the outermost arrow indicating rotation of the blade wheel 14. Absence of an arrow means that the corresponding wheel is not rotating.

To begin slotting or cutting the box blanks 164, the controller 82 first places the slotter blade 16 in the cutting position by shifting the clutch assembly 76 to the engaged position and the brake assembly 78 to the unbraked position. As indicated by the arrows in FIG. 5, this couples the blade wheel 14 with the drive wheel 24 so that they rotate together. Since the slotter blade 16 is secured to the blade wheel 14, the slotter blade 16 makes a slot during every rotation of the drive wheel 24. During this first cut or slot, an arbitrary home point on the drive wheel 24 designated by the "0" on its front face is at the leading edge of the slotter blade 16.

Once a slot is made, it may be necessary to allow the rotatable drive assembly 12 to continue to advance the box blank 164 without further slotting. This allows the slotter wheel apparatus 10 to form slots in larger boxes without use of a larger diameter drive wheel. The controller 82 accomplishes this by placing the slotter blade 16 in the idle position by shifting the clutch assembly 76 to the released position and shifting the brake assembly 78 to the braked position. As indicated by the arrows in FIG. 6, this decouples the blade wheel 14 from the drive wheel 24 and locks the blade wheel 14 in a stationary, non-cutting position. This also causes the spring 124 to wind about the spring drum 148 on the blade wheel 14.

Figure 7:
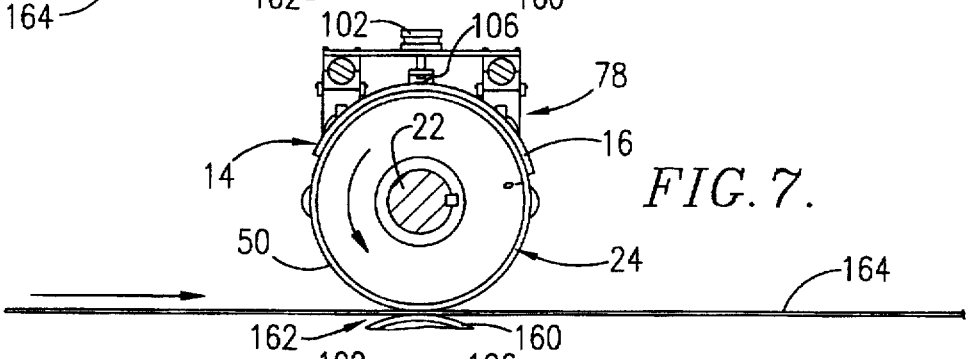
FIG. 7 is a front end elevational view illustrating the blade wheel and slotter blade positioned in a second idle position.
Figure 8:
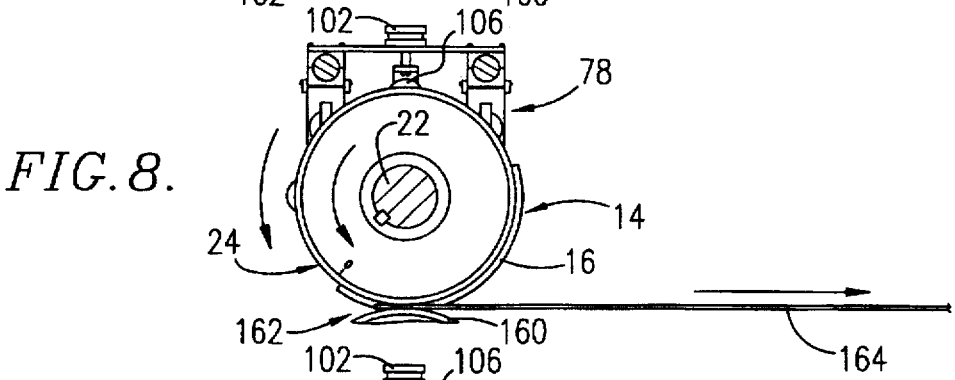
FIG. 8 is a front end elevational view illustrating the blade wheel and slotter blade positioned in a second cutting position.

As illustrated in FIG. 7, while the blade wheel 14 is in the idle position, the drive wheel 24 continues to rotate so that the "0" home position on the drive wheel is at the trailing edge of the slotter blade 16. At this point, the controller 82 once again places the slotter blade 16 in the cutting position by shifting the clutch assembly 76 to the engaged position and the brake assembly 78 to the unbraked position. This allows the slotter blade 16 to make a second cut in the box blank 164.

Figure 9:
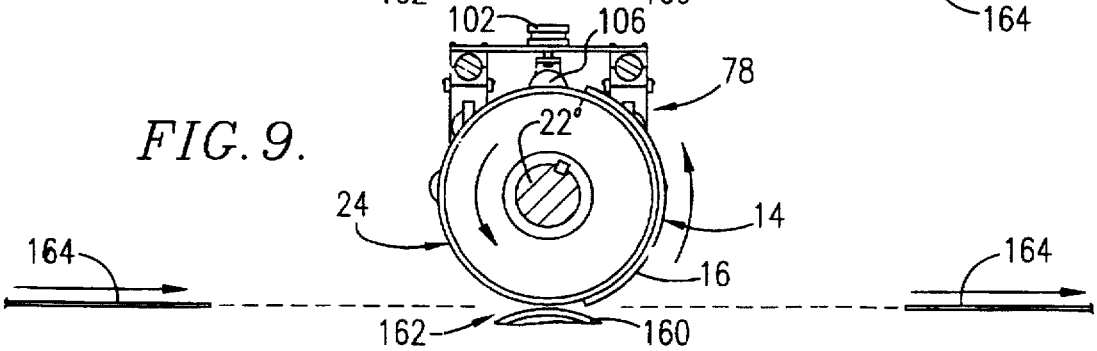
FIG. 9 is a front end elevational view illustrating the blade wheel and slotter blade positioned in the coast position.

Once the second cut is made, the controller 82 positions the slotter blade 16 in the coast position by shifting the clutch assembly 76 to the released position and shifting the brake assembly 78 to the unbraked position. As illustrated in FIG. 9, this decouples the blade wheel 14 from the drive wheel 24 and releases the brake assembly 78 so that the blade wheel 14 rotates freely but independently of the drive wheel 24. Since the spring 124 became stretched in the above-described idle positions, it recoils and causes the blade wheel 14 to rotate faster than the drive wheel 24 and overtake the drive wheel 24. The blade wheel 14 coasts until the snubber 136 engages the spring stop 138. As illustrated by FIG. 9, the coasting ends once the "0" position is once again at the leading edge of the slotter blade.

III. Construction of FIGS. 10–12

Figure 11:
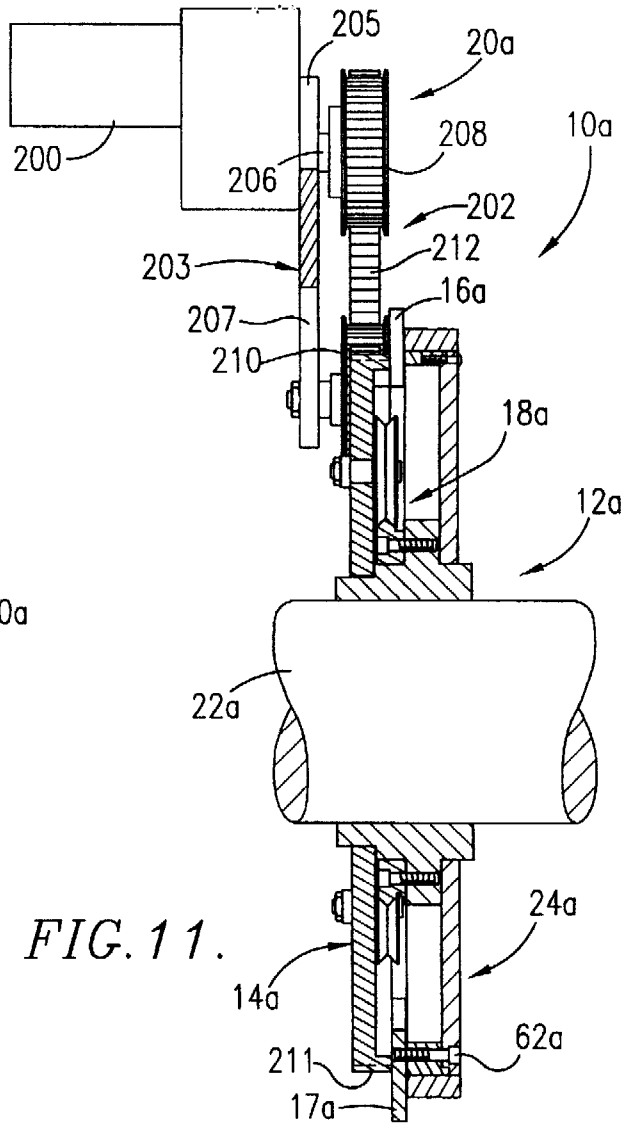
FIG. 11 is a sectional view taken along line 11—11 of FIG. 10.
Figure 10:
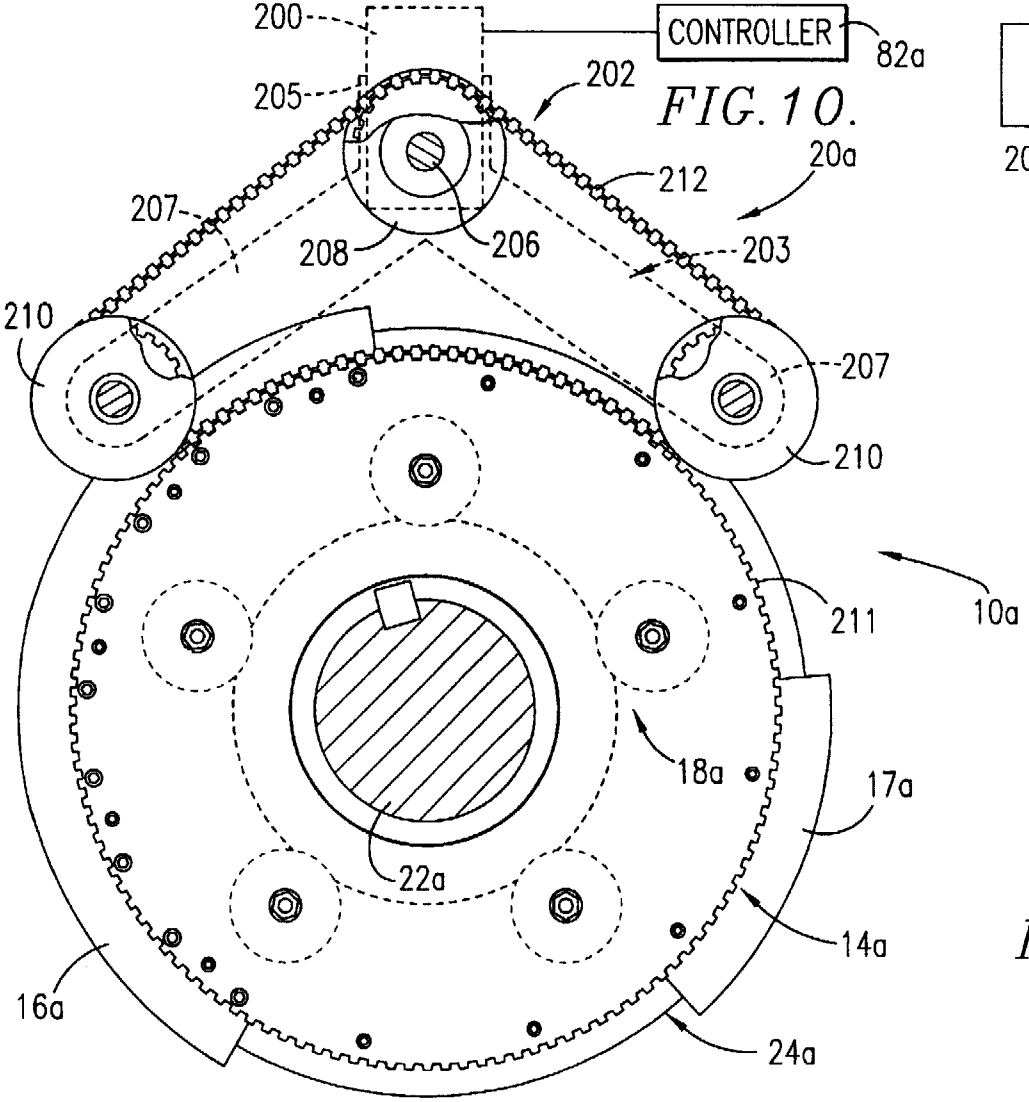
FIG. 10 is a front end elevational view constructed in accordance with a second embodiment of the invention.
Figure 12:
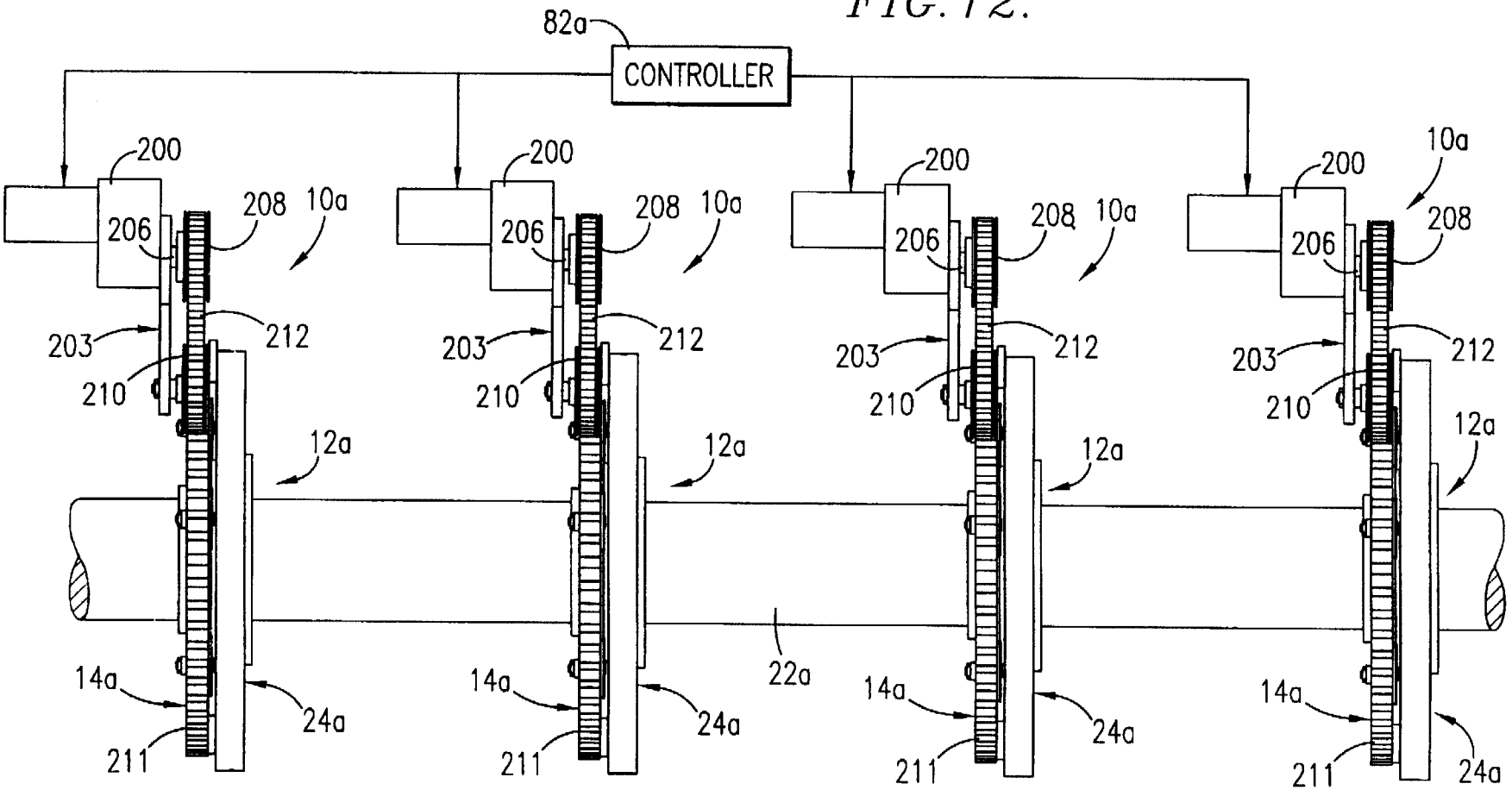
FIG. 12 is a schematic view of a plurality of adjacent slotter wheel apparatuses cooperatively positioned for forming a plurality of slots in box blanks.

Turning now to FIGS. 10 and 11, a slotter wheel apparatus **10*a* constructed in accordance with a second embodiment of the invention is depicted. The slotter wheel apparatus 10*a* includes a rotatable drive assembly 12*a*, a rotatable blade wheel 14*a*, a slotter blade 16*a* coupled with the blade wheel 14*a*, and support structure 18*a* for supporting the blade wheel so that it rotates about the same axis as the drive assembly 12*a***. Each of these components is substantially identical to the like-numbered components described in the first embodiment of the invention.

The slotter wheel apparatus **10*a* of the second embodiment of the invention also includes blade rotating structure 20*a* for selectively rotating the slotter blade 16*a* relative to the drive wheel 24*a* independently of the drive shaft 22*a* and a second slotter blade 17*a* coupled with the drive wheel 24*a* of the drive assembly 12*a***.

In more detail, the blade rotating structure **20*a* broadly includes a servo motor 200 and a gear assembly 202. The servo motor 200 is of conventional construction and has a rotatable shaft 206. The servo motor 200** is coupled with a suitable source of electric power.

The gear assembly 202 includes a support yoke 203, a drive pulley 208 and two idler pulleys 210. The support yoke 203 is a metallic support member including a vertically extending leg section 205 and two depending leg sections 207.

The drive pulley 208 is rotatably supported on the vertically extending leg 205 of the yoke 203 and is rotatably coupled with the servo motor shaft 206. The idler pulleys 210 are rotatably mounted on the depending leg sections 207. A cogged belt 212 is positioned over the drive and idler pulleys 208 and 210 and is rotated by the servo motor 200. The cogged belt 212 engages teeth 211 formed along the circumference of the blade wheel **14*a*. The blade rotating structure 20*a* also includes a controller 82*a* for controlling the rotational speed of the servo motor 200**.

The second slotter blade **17*a* is of conventional construction and includes an arcuate metallic body presenting a cutting edge. The second slotter blade 17*a*** can be manufactured in various sizes for forming slots and cuts of any length and width in box blanks.

The second slotter blade 17a is secured to the drive wheel 24a of the drive assembly 12a by screws 62a. Since the second slotter blade rotates with the drive wheel 24a, it makes cuts or slots in blanks passing under the apparatus 10a during every rotation of the drive wheel 24a. As described in more detail below, the second slotter blade is used when box blanks of conventional size are to be slotted. When it is desired to space slots further apart to form larger boxes, the second slotter blade 17a can be removed from the drive wheel 24a.

IV. Operation of Construction Illustrated in FIGS. 10–12

In operation of the second embodiment of the invention, the components of the blade rotating structure 20a cooperate for rotating the slotter blade 16a independently of the drive assembly 12a. The rotational speed of the slotter blade 16a can be selectively adjusted relative to the rotational speed of the drive wheel 24a so that the slotting blade 16a can be placed in either a cutting position or an idle, non-cutting position. For example, the controller 82a and servo motor 200 can initially rotate the drive wheel at the same rotational speed as the drive wheel 24a so that the slotter blade 16a makes slots or cuts during every rotation of the drive wheel 24a. Then, the controller 82a and servo motor 200 can stop the rotation of the blade wheel 14a to allow the rotatable drive assembly 12a to continue to advance a box blank without further slotting.

The second slotter blade is used when box blanks of a more conventional size are to be slotted. When the second slotter blade 17a is secured to the drive wheel 24a, it rotates with the drive wheel and makes a first cut or slot in a box blank passing under the apparatus 10a during every rotation of the drive wheel 24a. The blade rotating structure 20a rotates the first slotter blade 16a and positions it relative to the second slotter blade 16a to make a second cut or slot in the box blank.

The size of the box to be formed is determined by the spacing between the two slotter blades. For example, if relatively small boxes are to be formed, the blade rotating structure 20a rotates the first slotter blade 16a so that it makes a slot or cut that is in close proximity to the slot or cut made by the second slotter blade 17a. Conversely, if relatively larger boxes are to be formed, the blade rotating structure 20a rotates the first slotter blade 16a so that it makes a slot or cut that is remote from the slot or cut made by the second slotter blade 17a. When it is desired to space slots even further apart to form the largest sized boxes, the second slotter blade 17a is entirely removed from the drive wheel 24a and the first slotter blade 16a is used for making all cuts or slots in the box blanks.

Although the invention has been described with reference to the preferred embodiment illustrated in the attached drawing figures, it is noted that equivalents may be employed and substitutions made herein without departing from the scope of the invention as recited in the claims.

Having thus described the preferred embodiment of the invention, what is claimed as new and desired to be protected by Letters Patent includes the following:

1. A slotter wheel apparatus for slotting box blanks at selectively variable locations along the length of the blanks as the blanks are transported along a path of movement through the apparatus, said slotter wheel apparatus comprising:

a rotatable drive assembly including an elongated rotatable drive shaft extending in a direction generally transverse to the path of movement of the blanks, said shaft presenting a longitudinal axis;

at least one slotter blade presenting a cutting edge;

blade support means for supporting said slotter blade on the drive assembly for rotation about the longitudinal axis of said drive shaft; and blade coupling means for selectively coupling said slotter blade with said drive assembly so that said slotter blade is rotated by said drive shaft through the path of movement of the blanks, and for selectively decoupling said slotter blade from said drive assembly for rotation of said drive shaft relative to said slotter blade for preventing said slotter blade from rotating through the path of movement of the blanks during continued rotation of said drive shaft, said blade coupling means including structure for effecting said coupling and decoupling without stopping the rotation of said drive assembly and during passage of said blanks through the apparatus, and for selective rotation of said drive shaft through a full 360 degrees of rotation relative to the decoupled balde.

2. The apparatus as set forth in claim 1, said rotatable drive assembly further including a drive wheel operably coupled with said drive shaft for rotation therewith, said drive wheel presenting an outer circumferential edge.

3. The apparatus as set forth in claim 2, further including a rotatable blade wheel for holding and securing said slotter blade thereon, said rotatable blade wheel being positioned along the longitudinal axis of said drive shaft adjacent said drive wheel.

4. The apparatus as set forth in claim 3, said blade support means including a circular track coupled with said drive wheel.

5. The apparatus as set forth in claim 4, said blade support means further including a plurality of blade wheel rollers coupled with said blade wheel, wherein said rollers are operable for engaging said track for allowing said blade wheel to rotate about said drive shaft.

6. The apparatus as set forth in claim 3, said blade coupling means including a clutch assembly operably coupled with said drive wheel and said blade wheel, said clutch assembly being selectively shiftable between an engaged position for coupling said blade wheel with said drive wheel so that said blade wheel rotates with said drive wheel and a released position for decoupling said blade wheel from said drive wheel so that said blade wheel rotates independently of said drive wheel.

7. The apparatus as set forth in claim 6, said blade coupling means further including a brake assembly operably coupled with said blade wheel, said brake assembly being selectively shiftable between a braked position for stopping the rotation of said blade wheel and an unbraked position for allowing rotation of said blade wheel.

8. The apparatus as set forth in claim 7, said blade coupling means further including control means for controlling the shifting of said clutch assembly between said engaged and released positions and for controlling the shifting of said brake assembly between said braked and unbraked positions.

9. The apparatus as set forth in claim 8, said control means being operable for simultaneously shifting said clutch assembly to said engaged position and said brake assembly to said unbraked position for coupling said slotter blade with said drive shaft so that said slotter blade is rotated by said drive shaft and slots blanks passing through the path of movement of said apparatus.

10. The apparatus as set forth in claim 8, said control means being operable for simultaneously shifting said clutch assembly to said released position and said brake assembly to said braked position for decoupling said slotter blade from said drive shaft and braking rotation of said slotter blade to prevent said slotter blade from being rotated through the path of movement of the blanks during continued rotation of said drive shaft.

11. The apparatus as set forth in claim 8, said blade coupling means further including a spring assembly, said spring assembly including an elongated spring having opposed ends, wherein one spring end is attached to said drive wheel and the other spring end is attached to said blade wheel so that when said clutch assembly is in said released position and said brake assembly is in said braked position, said spring becomes stretched, and when said clutch assembly is in said released position and said brake assembly is in said unbraked position, said spring recoils and causes said blade wheel to rotate faster than said drive wheel.

12. The apparatus as set forth in claim 11, said spring assembly further including a snubber coupled with said blade wheel and a spring stop coupled with said drive wheel, said snubber and said spring stop being cooperatively positioned so that when said clutch assembly is in said released position and said brake assembly is in said unbraked position, said snubber and said stop limit the rotational travel of said blade wheel relative to said drive wheel.

13. The apparatus as set forth in claim 1, further including rotatable anvil means spaced a distance from said rotatable drive assembly and defining a region therebetween for receiving the box blanks for slotting.

14. The apparatus as set forth in claim 13, said anvil means including an opening for reception of said slotter blade.

15. A slotter wheel apparatus for slotting box blanks at selectively variable locations along the length of the blanks as the blanks are transported along a path of movement through the apparatus, said slotter wheel apparatus comprising:

a rotatable drive assembly including an elongated rotatable drive shaft extending in a direction generally transverse to the path of movement of the blanks, said shaft presenting a longitudinal axis, and a drive wheel operably coupled with said rotatable shaft for rotation therewith;

at least one blade wheel positioned along the longitudinal axis of said drive shaft adjacent said drive wheel;

a slotter blade coupled with said blade wheel and presenting a cutting edge;

blade support means for supporting said blade wheel and said slotter blade on the drive assembly for rotation about said drive shaft; and blade coupling means including clutch assembly operably coupled with said drive wheel and said blade wheel, said clutch assembly being selectively shiftable between an engaged position for coupling said blade wheel with said drive wheel so that said blade wheel rotates with said drive wheel, and a released position for decoupling said blade wheel from said drive wheel so that said blade wheel rotates independently of said drive wheel for rotation of said drive wheel relative to said blade wheel, a brake assembly operably coupled with said blade wheel, said brake assembly being selectively shiftable between a braked position for stopping the rotation of said blade wheel, and an unbraked position for allowing rotation of said blade wheel, and control means for controlling the shifting of said clutch assembly between said engaged and released positions and for controlling the shifting of said brake assembly between said braked and unbraked positions for selectively rotating said slotter blade between cutting and non-cutting positions, said blade coupling means operable for effecting said coupling and decoupling without stopping the rotation of said drive assembly and during passage of said blanks through said apparatus, and for selective rotation of said drive wheel through a full 360 degrees of rotation relative to the decoupled blade wheel.

16. The apparatus as set forth in claim 15, said blade support means including a circular track coupled with said drive wheel.

17. The apparatus as set forth in claim 16, said blade support means further including a plurality of blade wheel rollers coupled with said blade wheel, wherein said rollers are operable for engaging said track for allowing said blade wheel to rotate about said drive shaft.

18. The apparatus as set forth in claim 15, said blade coupling means further including a spring assembly, said spring assembly including an elongated spring having opposed ends, wherein one spring end is attached to said drive wheel and the other spring end is attached to said blade wheel so that when said clutch assembly is in said released position and said brake assembly is in said braked position, said spring becomes stretched, and when said clutch assembly is in said released position and said brake assembly is in said unbraked position, said spring recoils and causes said blade wheel to rotate faster than said drive wheel.

19. The apparatus as set forth in claim 18, said spring assembly further including a snubber coupled with said blade wheel and a spring stop coupled with said drive wheel, said snubber and said spring stop being cooperatively positioned so that when said clutch assembly is in said released position and said brake assembly is in said unbraked position, said snubber and said stop limit the rotational travel of said blade wheel relative to said drive wheel.

20. The apparatus as set forth in claim 15, further including rotatable anvil means spaced a distance from said rotatable drive assembly and defining a region therebetween for receiving the box blanks for slotting.

21. The apparatus as set forth in claim 20, said anvil means including an opening for reception of said slotter blade when the slotter blade is moved to said cutting position.

22. A slotter wheel apparatus for slotting box blanks at selectively variable locations along the length of the blanks as the blanks are transported along a path of movement through the apparatus, said slotter wheel apparatus comprising:

a rotatable drive assembly including an elongated rotatable drive shaft extending in a direction generally transverse to the path of movement of the blanks and defining a longitudinal axis about which the shaft is rotatable;

a slotter blade presenting a cutting edge;

blade support means for supporting said slotter blade on the drive shaft for rotation relative to the drive shaft about the longitudinal axis; and a gear assembly for selectively rotating said slotter blade with said drive shaft so that said slotter blade rotates through the path of movement of the blanks and slots the blanks, and for selectively stopping the rotation of said slotter blade, said gear assembly including a servo motor having a rotatable gear shaft, means including a drive belt coupled with said rotatable gear shaft for rotation therewith, and a toothed blade wheel coupled with said drive belt and attached to said slotter blade for rotating said slotter blade upon rotation of said rotatable gear shaft.

23. Slotter wheel apparatus for slotting of a box blank traveling along a path of travel through the apparatus and comprising:

an elongated shaft oriented transverse to said path of travel;

a blade support mounted for rotation about said shaft;

a slotter blade operatively coupled with said blade support;

motive means coupled with said support and blade for rotation of said support and blade about and relative to said shaft through a full 360 degrees rotation around the shaft; and control means coupled with said motive means for selectively rotating the support and blade around the shaft into slotting engagement with said blank, and for selectively stopping rotation of the support and blade at an idle position permitting passage of portions of said blank through the apparatus without slotting thereof, whereby said blank may be slotted at spaced apart locations with any desired distance between the slots.

24. The apparatus as set forth in claim 23, said motive means including a motor having a rotatable motor shaft supporting a rotatable shaft-driven pulley, and belt means operably coupled between said shaft-driven pulley and said blade support.

25. The apparatus as set forth in claim 24, said motor comprising a servo-motor.

26. The apparatus as set forth in claim 24, said blade support presenting a series of teeth on the periphery thereof, said belt means drivingly engaging said blade support teeth.

27. The apparatus as set forth in claim 26, said motive means further including a pair of idler pulleys adjacent said shaft-driven pulley, said belt means being continuous and trained about said shaft-driven pulley and said idler pulleys, said peripheral teeth on said blade support engaging said belt means between said idler pulleys.

28. The apparatus as set forth in claim 23, said control means including a programmable electronic controller.

29. The apparatus as set forth in claim 23, including a second slotter blade, said second slotter blade mounted for rotation with said elongated shaft.

* * * * *